US009671183B2

(12) United States Patent
Jones

(10) Patent No.: US 9,671,183 B2
(45) **Date of Patent: *Jun. 6, 2017**

(54) CONTROLLING COOLING FLOW IN A SOOTBLOWER BASED ON LANCE TUBE TEMPERATURE

(71) Applicant: INTERNATIONAL PAPER COMPANY, Memphis, TN (US)

(72) Inventor: Andrew K. Jones, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/766,131

(22) Filed: Feb. 13, 2013

(65) Prior Publication Data

US 2013/0152973 A1 Jun. 20, 2013

Related U.S. Application Data

(63) Continuation of application No. 12/002,434, filed on Dec. 17, 2007, now Pat. No. 8,381,690.

(51) Int. Cl.
*F28G 1/12* (2006.01)
*F28G 9/00* (2006.01)
(Continued)

(52) U.S. Cl.
CPC ..... *F28G 9/00* (2013.01); *F22B 37/486* (2013.01); *F22B 37/52* (2013.01); *F22B 37/54* (2013.01);
(Continued)

(58) Field of Classification Search
USPC ..... 122/390, 392; 134/22.15
See application file for complete search history.

(56) References Cited

U.S. PATENT DOCUMENTS 2,416,462 A 2/1947 Wilcoxson
2,819,702 A 1/1958 Koch
(Continued)

FOREIGN PATENT DOCUMENTS

CA 2387369 10/2009
EP 0071815 2/1983
(Continued)

*Primary Examiner* — Alissa Tompkins
*Assistant Examiner* — John Bargero
(74) *Attorney, Agent, or Firm* — Thomas W. Barnes, III

(57) ABSTRACT

A cleaning system and method for cleaning heat transfer surfaces in a boiler using a temperature measuring system for measuring and monitoring wall temperature of an annular wall of the tube of a lance of one or more sootblowers. Controlling a flow of steam or other fluid through the tube during the cooling portions of the strokes based on wall temperature measurements from the temperature measuring system. Infrared or thermocouple temperature measuring systems may be used. The steam or other fluid may be flowed at a default flowrate that may be substantially zero until the temperature measuring system indicates the wall temperature of the annular wall begins to exceed a predetermined temperature limit which may be the softening point of the annular wall. Then the steam or other fluid is flowed at a rate greater than the default flowrate.

26 Claims, 4 Drawing Sheets

(51) Int. Cl.

| | |
|---|---|
| ***F22B 37/48*** | (2006.01) |
| ***F22B 37/52*** | (2006.01) |
| ***F22B 37/54*** | (2006.01) |
| ***F22B 37/56*** | (2006.01) |
| ***F28G 3/16*** | (2006.01) |
| ***F28G 15/00*** | (2006.01) |

(52) U.S. Cl.
CPC ..... *F22B 37/56* (2013.01); *F28G 3/166* (2013.01); *F28G 15/003* (2013.01)

(56) References Cited

U.S. PATENT DOCUMENTS 2,830,440 A 4/1958 Durham
2,832,323 A 4/1958 Craig
2,962,006 A 11/1960 Blodgett
2,966,896 A 1/1961 Vogler
3,028,844 A 4/1962 Durham et al.
3,040,719 A 6/1962 Dickey
3,161,180 A 12/1964 Durham et al.
3,207,134 A 9/1965 Miller
3,246,635 A 4/1966 Powell et al.
3,274,979 A 9/1966 Petit
3,291,106 A 12/1966 Palchik et al.
3,362,384 A 1/1968 Caracristi
3,364,903 A 1/1968 Covell et al.
3,439,376 A 4/1969 Nelson et al.
3,452,722 A 7/1969 Evers
3,575,002 A 4/1971 Vuia
3,955,358 A 5/1976 Martz et al.
3,965,675 A 6/1976 Martz et al.
3,974,644 A 8/1976 Martz et al.
4,004,647 A 1/1977 Forst et al.
4,028,884 A 6/1977 Martz et al.
4,031,404 A 6/1977 Martz et al.
4,037,469 A 7/1977 Nordstrom et al.
4,085,438 A 4/1978 Butler
4,099,384 A 7/1978 Stevens et al.
4,237,825 A 12/1980 Kochey
4,339,998 A 7/1982 Finch
4,351,277 A 9/1982 Ryan et al.
4,359,800 A 11/1982 Ziels
4,375,710 A 3/1983 Hammond
4,377,134 A 3/1983 Frey
4,380,843 A 4/1983 Sullivan et al.
4,411,204 A 10/1983 Hamilton
4,421,067 A 12/1983 Krowech
4,422,882 A 12/1983 Nelson et al.
4,430,963 A 2/1984 Finet
4,454,840 A 6/1984 Dziubakowski
4,466,383 A 8/1984 Klatt et al.
4,475,482 A 10/1984 Moss et al.
4,488,516 A 12/1984 Bueters et al.
4,492,187 A 1/1985 Hammond
4,539,840 A 9/1985 Klatt et al.
4,565,324 A 1/1986 Rebula et al.
4,567,622 A 2/1986 Ziels
4,599,975 A * 7/1986 Reeve et al. ..... 122/379
4,621,583 A 11/1986 Kaski
4,716,856 A 1/1988 Beisswenger et al.
4,718,363 A 1/1988 Williames
4,718,376 A 1/1988 Leroueil et al.
RE32,723 E 8/1988 Neundorfer
4,779,690 A 10/1988 Woodman
4,803,959 A 2/1989 Sherrick et al.
4,887,431 A 12/1989 Peet
4,920,994 A 5/1990 Nachbar
4,957,049 A 9/1990 Strohmeyer
4,980,674 A 12/1990 Scheibel et al.
4,986,391 A 1/1991 Salmon
4,996,951 A 3/1991 Archer et al.
5,027,751 A 7/1991 Archer et al.
5,048,636 A 9/1991 Roehrs
5,050,108 A 9/1991 Clark et al.
5,063,632 A 11/1991 Clark et al.
5,065,472 A 11/1991 Carpenter et al.
5,090,087 A 2/1992 Hipple et al.
5,113,802 A 5/1992 Leblanc
5,181,482 A 1/1993 Labbe et al.
5,209,324 A 5/1993 Hogbacka
5,230,306 A 7/1993 Barringer et al.
5,237,718 A 8/1993 Brown
5,241,723 A 9/1993 Garrabrant
5,261,965 A 11/1993 Moslehi
5,267,533 A 12/1993 Smith
5,271,356 A 12/1993 Kling et al.
5,286,063 A 2/1994 Huston
5,299,533 A 4/1994 Johnston et al.
5,305,713 A 4/1994 Vadakin
5,320,073 A 6/1994 Silcott et al.
5,348,774 A 9/1994 Golecki et al.
5,353,996 A 10/1994 Gallacher et al.
5,365,890 A 11/1994 Johnston, Jr. et al.
5,375,771 A 12/1994 Jamelle et al.
5,379,727 A 1/1995 Kling et al.
5,398,623 A 3/1995 Lautenschlager et al.
5,416,946 A * 5/1995 Brown ..... F28G 1/16 122/390
5,423,272 A 6/1995 Dunn et al.
5,423,483 A 6/1995 Schwade
5,429,076 A 7/1995 Johnston, Jr. et al.
5,477,683 A 12/1995 Persson
5,505,163 A 4/1996 Jameel
5,509,607 A 4/1996 Booher et al.
5,522,348 A 6/1996 Tanaka et al.
5,530,987 A 7/1996 Piccirillo et al.
5,549,079 A 8/1996 Johnston, Jr. et al.
5,549,305 A 8/1996 Freund
5,553,778 A 9/1996 Jameel et al.
5,605,117 A 2/1997 Moskal
5,606,924 A 3/1997 Martin et al.
5,615,734 A 4/1997 Hyp
5,619,771 A 4/1997 Minic
5,626,184 A 5/1997 Campbell et al.
5,663,489 A 9/1997 Thungstrom et al.
5,675,863 A 10/1997 Holden et al.
5,740,745 A 4/1998 Smyrniotis et al.
5,745,950 A 5/1998 Holden et al.
5,756,880 A 5/1998 Chen et al.
5,765,510 A 6/1998 Krowech et al.
5,769,034 A 6/1998 Zilka et al.
5,769,035 A 6/1998 Fiedler
5,778,830 A 7/1998 Wall
5,778,831 A 7/1998 Jameel
5,793,014 A 8/1998 Sobkowiak et al.
5,836,268 A 11/1998 Wall
5,894,806 A 4/1999 Smyrniotis et al.
5,920,951 A 7/1999 Piccirillo et al.
5,943,865 A 8/1999 Cohen
5,983,639 A 11/1999 Kral et al.
6,065,528 A 5/2000 Fierle et al.
6,073,641 A * 6/2000 Bude et al. ..... 134/172
6,105,590 A 8/2000 Martin et al.
6,109,096 A 8/2000 Chen et al.
6,170,117 B1 1/2001 Batt
6,178,924 B1 1/2001 Hakulinen et al.
6,244,098 B1 6/2001 Chen et al.
6,321,690 B1 11/2001 Zilka et al.
6,323,442 B1 11/2001 Jones
6,325,025 B1 12/2001 Perrone
6,425,352 B2 7/2002 Perrone
6,431,073 B1 8/2002 Zilka et al.
6,437,285 B1 8/2002 Thomas et al.
6,575,122 B2 6/2003 Hipple
6,581,549 B2 6/2003 Stewart et al.
6,604,468 B2 8/2003 Zilka et al.
6,644,201 B2 11/2003 Zilka et al.
6,710,285 B2 3/2004 Brown et al.
6,715,499 B2 4/2004 Bartels et al.
6,725,911 B2 4/2004 Jayaweera et al.
6,736,089 B1 5/2004 Lefebvre et al.
6,755,156 B1 6/2004 Zilka et al.
6,764,030 B2 7/2004 Habib et al.
6,772,775 B2 8/2004 Ackerman et al.

(56) References Cited

U.S. PATENT DOCUMENTS

| | | | |
|---|---|---|---|
| 6,782,902 | B2 | 8/2004 | Shover et al. |
| 6,892,679 | B2 | 5/2005 | Jameel et al. |
| 6,964,709 | B2 | 11/2005 | Matsumoto et al. |
| 7,017,500 | B2 | 3/2006 | Jones |
| 7,028,926 | B2 | 4/2006 | Habib et al. |
| 7,055,209 | B2 | 6/2006 | Zalewski |
| 7,204,208 | B2 | 4/2007 | Johnson et al. |
| 7,267,134 | B2 | 9/2007 | Hochstein, Jr. et al. |
| 7,341,067 | B2 | 3/2008 | Jones et al. |
| 7,395,760 | B2 | 7/2008 | Zilka et al. |
| 7,458,342 | B2 | 12/2008 | Lefebvre et al. |
| 7,584,024 | B2 | 9/2009 | Wroblewski et al. |
| 7,633,033 | B2 | 12/2009 | Thomas et al. |
| 7,735,435 | B2 | 6/2010 | Eriksson et al. |
| 8,381,690 | B2 | 2/2013 | Jones |
| 9,091,182 | B2 | 7/2015 | Labbe |
| 2002/0043192 | A1 | 4/2002 | Philippe et al. |
| 2004/0006841 | A1 | 1/2004 | Jameel et al. |
| 2004/0226758 | A1 | 11/2004 | Jones |
| 2005/0199743 | A1 | 9/2005 | Hochstein et al. |
| 2005/0252458 | A1 | 11/2005 | Saviharju et al. |
| 2006/0065291 | A1 | 3/2006 | Jones et al. |
| 2006/0236696 | A1 | 10/2006 | Saviharju et al. |
| 2009/0090311 | A1 | 4/2009 | James et al. |
| 2009/0151656 | A1 | 6/2009 | Jones |
| 2010/0064470 | A1 | 3/2010 | Dahlen et al. |
| 2010/0077946 | A1 | 4/2010 | D'Agostini |
| 2010/0101462 | A1 | 4/2010 | Hayashi et al. |
| 2010/0107636 | A1 | 5/2010 | Panchatsaram et al. |
| 2010/0199930 | A1 | 8/2010 | Tandra |
| 2011/0011315 | A1 | 1/2011 | Hayashi et al. |
| 2012/0270162 | A1 | 10/2012 | Dahlhielm et al. |
| 2014/0150825 | A1 | 6/2014 | Mueller et al. |
| 2015/0253003 | A1 | 9/2015 | Jones et al. |
| 2016/0025600 | A1 | 1/2016 | Carlier et al. |

FOREIGN PATENT DOCUMENTS

| | | |
|---|---|---|
| EP | 0602244 | 6/1994 |
| EP | 0905308 | 9/1998 |
| EP | 1063021 | 12/2000 |
| EP | 2784477 | 1/2014 |
| GB | 802032 | 9/1958 |
| GB | 1022254 | 9/1962 |
| GB | 1376805 | 12/1974 |
| GB | 2271440 | 4/1994 |
| GB | 2428312 | 1/2007 |
| JP | 62278217 | 12/1987 |
| JP | 10274408 | 10/1998 |
| JP | 2003156211 | 5/2003 |
| RU | 2143087 | 12/1999 |
| SU | 1214251 | 2/1986 |
| SU | 1291031 | 2/1987 |
| SU | 464031 | 3/1989 |
| WO | 9305338 | 3/1993 |
| WO | 9827384 | 6/1998 |
| WO | 03104547 | 12/2003 |
| WO | 2006037018 | 4/2006 |
| WO | 2007028447 | 3/2007 |
| WO | 2008057039 | 5/2008 |
| WO | 2009139714 | 11/2009 |
| WO | 2010098946 | 9/2010 |
| WO | 2014068325 | 5/2014 |

* cited by examiner

CONTROLLING COOLING FLOW IN A SOOTBLOWER BASED ON LANCE TUBE TEMPERATURE

BACKGROUND OF THE INVENTION

Field of the Invention

This invention relates generally to boilers and sootblowers and, in particular, to methods and apparatus for removing ash deposits on heat exchangers of the boilers and for minimizing a flowrate of steam or other cleaning fluid through the sootblowers when not actively cleaning the ash deposit.

Description of Related Art

In the paper-making process, chemical pulping yields, as a by-product, black liquor which contains almost all of the inorganic cooking chemicals along with the lignin and other organic matter separated from the wood during pulping in a digester. The black liquor is burned in a boiler. The two main functions of the boiler are to recover the inorganic cooking chemicals used in the pulping process and to make use of the chemical energy in the organic portion of the black liquor to generate steam for a paper mill. As used herein, the term boiler includes a top supported boiler that, as described below, burns a fuel which fouls heat transfer surfaces.

A Kraft boiler includes superheaters in an upper furnace that extract heat by radiation and convection from the furnace gases. Saturated steam enters the superheater section and superheated steam exits at a controlled temperature. The superheaters are constructed of an array of platens that are constructed of tubes for conducting and transferring heat. Superheater heat transfer surfaces are continually being fouled by ash that is being carried out of the furnace chamber. The amount of black liquor that can be burned in a Kraft boiler is often limited by the rate and extent of fouling on the surfaces of the superheater. The fouling, including ash deposited on the superheater surfaces, reduces the heat absorbed from the liquor combustion, resulting in reduced exit steam temperatures from the superheaters and high gas temperatures entering the boiler bank.

Boiler shutdown for cleaning is required when either the exit steam temperature is too low for use in downstream equipment or the temperature entering the boiler bank exceeds the melting temperature of the deposits, resulting in gas side pluggage of the boiler bank. In addition, eventually fouling causes plugging and, in order to remove the plugging, the burning process in the boiler has to be stopped. Kraft boilers are particularly prone to the problem of superheater fouling. Three conventional methods of removing ash deposits from the superheaters in Kraft boilers include: 1) sootblowing, 2) chill-and-blow, and 3) waterwashing. This application addresses only the first of these methods, sootblowing.

Sootblowing is a process that includes blowing deposited ashes off the superheater (or other heat transfer surface that is plagued with ash deposits, with a blast of steam from nozzles of a lance of a sootblower. A sootblower lance has a lance tube for conducting the steam to a nozzle at a distal end of the lance. Sootblowing is performed essentially continuously during normal boiler operation, with different sootblowers turned on at different times. Sootblowing is usually carried out using steam. The steam consumption of an individual sootblower is typically 4-5 kg/s; as many as 4 sootblowers are used simultaneously. Typical sootblower usage is about 3-7% of the steam production of the entire boiler. The sootblowing procedure thus consumes a large amount of thermal energy produced by the boiler.

The sootblowing process may be part of a procedure known as sequence sootblowing, wherein sootblowers operate at determined intervals in an order determined by a certain predetermined list. The sootblowing procedure runs at its own pace according to the list, irrespective of whether sootblowing is needed or not. Often, this leads to plugging that cannot necessarily be prevented even if the sootblowing procedure consumes a high amount of steam. Each sootblowing operation reduces a portion of the nearby ash deposit but the ash deposit nevertheless continues to build up over time. As the deposit grows, sootblowing becomes gradually less effective and results in impairment of the heat transfer. When the ash deposit reaches a certain threshold where boiler efficiency is significantly reduced and sootblowing is insufficiently effective, deposits may need to be removed by another cleaning process.

A steam sootblower, typically, includes a lance having an elongated tube with a nozzle at a distal end of the tube and the nozzle has one or more radial openings. The tube is coupled to a source of pressurized steam. The sootblowers are further structured to be inserted and extracted into the furnace or moved between a first position located outside of the furnace, to a second location within the furnace. As the sootblowers move between the first and second positions, the sootblower rotates and adjacent to the heat transfer surfaces. Sootblowers are arranged to move generally perpendicular to the heat transfer surfaces.

Some of the platens having heat transfer surfaces have passages therethrough to allow movement perpendicular to the heat transfer surfaces. The movement into the furnace, which is typically the movement between the first and second positions, may be identified as a "first stroke" or insertion, and the movement out of the furnace, which is typically the movement between the second position and the first position, may be identified as the "second stroke" or extraction. Generally, sootblowing methods use the full motion of the sootblower between the first position and the second position; however, a partial motion may also be considered a first or second stroke.

As the sootblower moves adjacent to the heat transfer surfaces, the steam is expelled through the openings in the nozzle. The steam contacts the ash deposits on the heat transfer surfaces and dislodges a quantity of ash, some ash, however, remains. As used herein, the term "removed ash" shall refer to the ash deposit that is removed by the sootblowing procedure and "residual ash" shall refer to the ash that remains on a heat transfer surface after the sootblowing procedure. The steam is usually applied during both the first and second strokes.

Rather than simply running the sootblowers on a schedule, it may be desirable to actuate the sootblowers when the ash buildup reaches a predetermined level. One method of determining the amount of buildup of ash on the heat transfer surfaces within the furnace is to measure the weight of the heat transfer surfaces and associated superheater components. One method of determining the weight of the deposits is disclosed in U.S. Pat. No. 6,323,442 and another method is disclosed in U.S. patent application Ser. No. 10/950,707, filed Sep. 27, 2004, both of which are incorporated herein by reference. It is further desirable to conserve energy by having the sootblowers use a minimum amount of steam when cleaning the heat transfer surfaces.

BRIEF SUMMARY OF THE INVENTION

A cleaning system for cleaning heat transfer surfaces of one or more heat exchangers in a boiler includes one or more sootblowers, each of which includes a lance with an elongated hollow tube and two nozzles at a distal end of the tube. A temperature measuring system is used for measuring and monitoring wall temperature of an annular wall of the tube during operation of the one or more sootblowers.

An exemplary embodiment of the cleaning system includes that each of the sootblowers is operable for moving the lance in and out of the boiler in insertion and extraction strokes and a control system is used for controlling a flow of steam or other cleaning fluid through the tube and nozzle during cleaning portions and cooling portions of the strokes. The control means is further operable for controlling the flow of steam during the cooling portions of the strokes based on wall temperature measurements from the temperature measuring system. The control means is further operable for controlling the flow of steam during the cooling portions of the strokes to prevent the wall temperature measurements from exceeding a predetermined temperature limit which may be a softening point or slightly less than the softening point of the tube.

The temperature measuring system may be an infrared temperature measuring system for measuring the wall temperature of the annular wall outside the boiler. The temperature measuring system may be a thermocouple temperature measuring system having thermocouples attached to the annular wall for measuring the wall temperature of the annular wall inside the boiler. The thermocouples may be partially disposed from an inside surface of the annular wall in holes through and along a length of the annular wall.

The method of operating the cleaning system may include flowing the steam or the other hot cleaning fluid through the tube and nozzle during the cooling portions of the strokes at a flowrate equal to a default value unless the wall temperature exceeds or is about to exceed the predetermined temperature limit based on temperature measurements from the temperature measuring system and, then, increasing the flowrate above the default value. The default value may be substantially zero.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
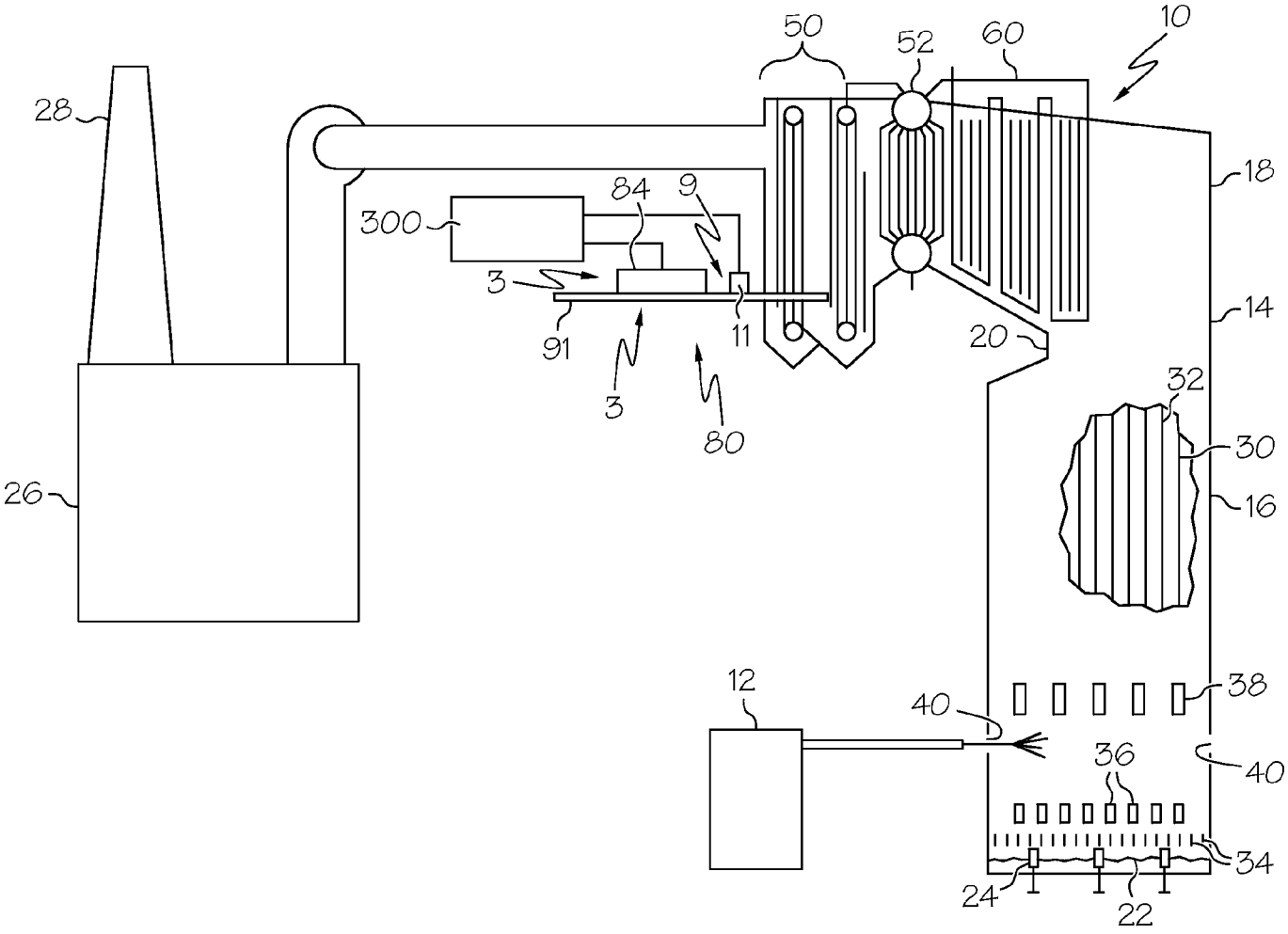
FIG. 1 is a diagrammatical illustration of a typical Kraft black liquor boiler system having several sootblowers and a temperature measuring system for measuring and monitoring lance tube temperature and basing a cleaning fluid flowrate through the sootblowers on the temperature.
Figure 5:
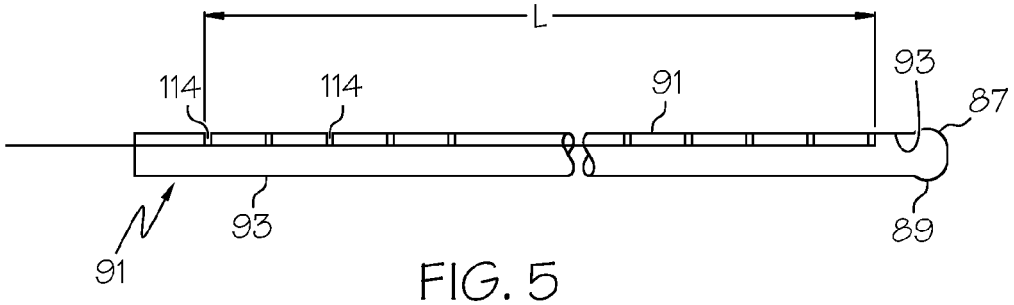
FIG. 5 is a diagrammatical illustration of a thermocouple temperature measuring system for measuring temperature of the tubes of the sootblower lances illustrated in FIGS. 1 and 2.
Figure 6:
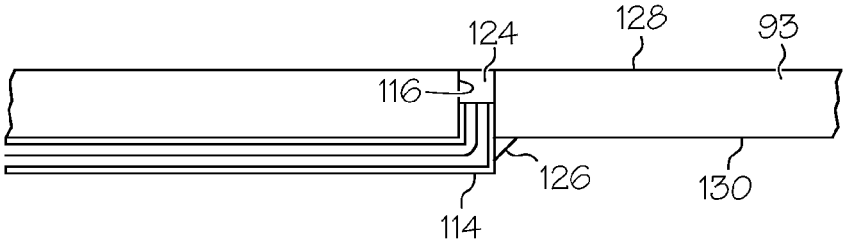
FIG. 6 is a diagrammatical illustration of a thermocouple mounted in the tube of the lance of the thermocouple temperature measuring system illustrated in FIG. 4.

Diagrammatically illustrated in FIG. 1 is an exemplary embodiment of a Kraft black liquor boiler system 10 having a sootblower system 3 with one or more sootblowers 84. A Kraft black liquor boiler system 10 having a plurality of sootblowers 84 is disclosed and described in U.S. patent application Ser. No. 10/950,707, filed Sep. 27, 2004, entitled "Method of Determining Individual Sootblower Effectiveness" which is incorporated herein by reference. A control system 300 which operates the sootblower 84 in part based on a measured temperature of an annular wall 93 of a tube 86 of a lance 91 of the sootblower. The sootblower 84 typically rotates the lance 91 during operation. The annular wall's 93 temperature is measured and/or monitored with a temperature measuring system 9 illustrated in FIG. 1 as an infrared temperature measuring system 11 as illustrated in more detail in FIGS. 3 and 4. Other types of temperature measuring systems may be used such as a thermocouple temperature measuring system 13 as illustrated in FIGS. 5 and 6.

Black liquor is a by-product of chemical pulping in the paper-making process and which is burned in the boiler system 10. The black liquor is concentrated to firing conditions in an evaporator 12 and then burned in a boiler 14. The black liquor is burned in a furnace 16 of the boiler 14. A bullnose 20 is disposed between a convective heat transfer section 18 in the boiler 14 and the furnace 16. Combustion converts the black liquor's organic material into gaseous products in a series of processes involving drying, devolatilizing (pyrolyzing, molecular cracking), and char burning/gasification. Some of the liquid organics are burned to a solid carbon particulate called char. Burning of the char occurs largely on a char bed 22 which covers the floor of the furnace 16, though some char burns in flight. As carbon in the char is gasified or burned, the inorganic compounds in the char are released and form a molten salt mixture called smelt, which flows to the bottom of the char bed 22, and is continuously tapped from the furnace 16 through smelt spouts 24. Exhaust gases are filtered through an electrostatic precipitator 26, and exit through a stack 28.

Vertical walls 30 of the furnace 16 are lined with vertically aligned wall tubes 32, through which water is evaporated from the heat of the furnace 16. The furnace 16 has primary level air ports 34, secondary level air ports 36, and tertiary level air ports 38 for introducing air for combustion at three different height levels. Black liquor is sprayed into the furnace 16 out of black liquor guns 40. The heat transfer section 18 contains three sets of tube banks (heat traps) which successively, in stages, heat the feedwater to superheated steam. The tube banks include an economizer 50, in which the feedwater is heated to just below its boiling point; a boiler bank 52, or "steam generating bank" in which, along with the wall tubes 32, the water is evaporated to steam; and a superheater system 60, which increases the steam temperature from saturation to the final superheat temperature.

Figure 2:
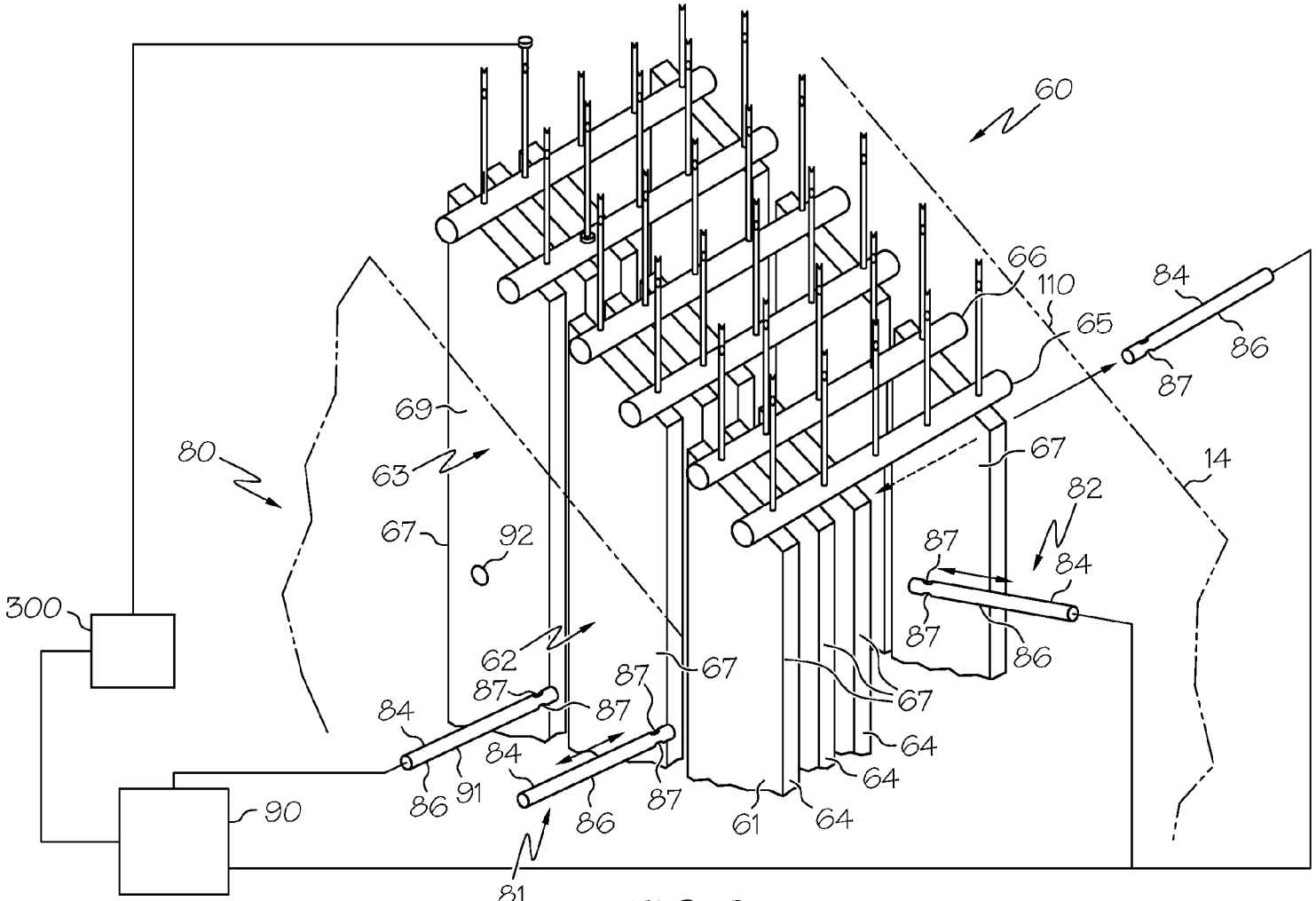
FIG. 2 is a diagrammatical illustration of the sootblowers in a superheater in the boiler system illustrated in FIG. 1.

Referring to FIG. 2, the superheater system 60 illustrated herein has first, second, and third superheaters 61, 62, and 63 for a total of three superheaters, however, more or less superheaters may be incorporated as needed. The construction of the three superheaters is the same. Each superheater is an assembly having at least one but typically more, such as 20-50, heat exchangers 64. Steam enters the heat exchangers 64 through a manifold tube called an inlet header 65. Steam is superheated within the heat exchangers 64 and exits the heat exchangers as superheated steam through another manifold tube called an outlet header 66. The heat exchangers 64 are suspended from the headers 65, 66 which are themselves suspended from the overhead beams by hanger rods not illustrated herein.

Platens 67 of the heat exchanger 64 have outer surfaces referred to herein as a heat transfer surfaces 69 which are exposed to the hot interior of the furnace 16. Thus, virtually all parts of the heat transfer surfaces are likely to be coated with ash during normal operation of the furnace 16. A substantial portion of the heat transfer surfaces are cleaned, that is, have a portion of ash removed, by a cleaning system 80. The cleaning system 80 includes at least one, and preferably a plurality of steam sootblowers 84, which are known in the art. The cleaning system 80 illustrated herein includes steam sootblowers 84; however the cleaning system 80 may also be used with sootblowers using other cleaning fluids. The sootblowers 84 are arranged to clean the heat exchangers and, more specifically, the heat transfer surfaces. Sootblowers 84 include elongated hollow tubes 86 having two nozzles 87 at distal ends 89 of the tubes 86. The two nozzles 87 spaced about 180 degrees apart.

The tubes 86 are in fluid communication with a steam source 90. In one embodiment of the cleaning system 80, the steam is supplied at a pressure of between about 200 to 400 psi. The steam is expelled through the nozzles 87 and onto the heat transfer surfaces. The sootblowers 84 are structured to move the nozzles 87 at the end of the tubes 86 inwardly between a first position, typically outside the furnace 16, and a second position, adjacent to the heat exchangers 64. The inward motion, between the first and second positions, is called an insertion stroke and an outwardly motion, between the second position and the first position, is called an extraction stroke.

A first set 81 of the sootblowers 84 are operable to move the nozzles 87 at the end of the tubes 86 generally perpendicular to and in between the heat exchangers 64. A second set 82 of the sootblowers 84 are operable to move the nozzles 87 at the end of the tubes 86 generally parallel to and in between the heat exchangers 64. A plurality of tubular openings 92 through the heat exchangers 64 are provided for allowing the tubes 86 of the first set 81 of the sootblowers 84 to move generally perpendicular through the heat exchangers 64. The heat exchangers 64 are sealed and the tubes 86 may pass freely through the tubular openings 92.

Steam is expelled from the nozzles 87 as the nozzles 87 move between the first and second positions. As the steam contacts the ash coated on the heat transfer surfaces, a portion of the ash is removed. Over time, the buildup of residual ash may become too resilient to be removed by the sootblowers 84 and an alternate ash cleaning method may be used. The sootblowers 84 described above utilize steam, it is noted however, that the invention is not so limited and the sootblowers may also use other cleaning fluids that for example may include air and water-steam mixtures.

Operation of the cleaning system 80 is controlled by a control system 300 which controls the cleaning system 80 based on the weight of the ash deposits on one or more of the heat exchangers 64. The control system 300 also controls the amount of steam supplied or the steam's flowrate to the tubes 86 during cleaning portions of the insertion and extraction strokes and during cooling portions of the insertion and extraction strokes. The control system 300 is programmed to activate the insertion and extraction of the lances 91 of the sootblowers 84, that is, movement between the lance's 91 first and second position, speed of travel, and the application and/or quantity of steam.

Cleaning steam is typically applied on the insertion stroke of the lances 91 but may also be applied on the extraction or both strokes. The steam is applied at a cleaning rate to remove the ash and at a cooling rate to prevent the lance 91 from getting too hot. In conventional Kraft boilers, steam has been applied at a cleaning rate or cleaning flow of between 15,000-20,000 lbs/hr and at a cooling rate or cooling flow of between 5,000-6,000 lbs/hr to ensure that the sootblower lance is operating well below the temperature limit of the material. The steam may be supplied anywhere from substantially zero to one hundred percent of the maximum quantity that the cleaning system is programmed to deliver. The control system 300 using the measured temperature of the annular wall 93, illustrated in FIGS. 3 and 6 of the tube 86 of the lance 91 from the temperature measuring system 9 to control and minimize the cooling flow. For a boiler using cleaning flow of between 15,000-20,000 lbs/hr, a cooling flow of between 0 and 2,000 lbs/hr may be achieved using the temperature measuring system 9 to control and minimize the cooling flow.

The use of steam to clean heat exchangers 64 is expensive. Therefore, it is desirable to use only the amount of steam needed to remove the ash. Substantially less steam is used during the cooling portions than the cleaning portions of the strokes. Cleaning or cooling amounts of steam may be used during either the insertion or extraction strokes. In one embodiment of the sootblowing method one-way cleaning is used to reduce the sootblowing steam used. One-way cleaning uses full cleaning flow during the insertion stroke into the boiler and only cooling flow during the extraction stroke or on the way out of the boiler. During the cooling portions of the stroke, steam is used only to keep the lances 91 of the sootblowers 84 cool. The temperature measuring system 9 is used to measure or monitor the temperature of the lance's tube 86 and minimize the amount of steam used during the cooling portions of the stokes.

The cleaning system 80 uses the temperature measuring system 9 to continuously measure or monitor the temperature of a sootblower lance tube 86 while it is operating in the boiler 14. The control system varies the cooling flow within the lance 91 (using a variable flow control valve not shown) to prevent the wall temperature of the annular wall 93 of the tube 86 of the lance 91 from exceeding a predetermined temperature limit. In one exemplary method of cleaning system 80, the amount of steam supplied or the steam's flowrate to the tubes 86 during the cooling portions of the strokes is set to a default value which may be substantially zero and is increased if the control system 300 determines that the wall temperature exceeds or is about to exceed the predetermined temperature limit based on temperature measurements from the temperature measuring system 9.

In one exemplary method of using the temperature measuring system 9, steam is supplied at a flowrate that is as low as possible without the temperature of the tube 86 rising above its softening point or temperature. Thus, the maximum allowable temperature of the tube 86 is its softening temperature. The flowrate of steam is minimized without allowing the lance's tube temperature to exceed its softening point based on direct temperature measurements of the tube 86.

Figure 3:
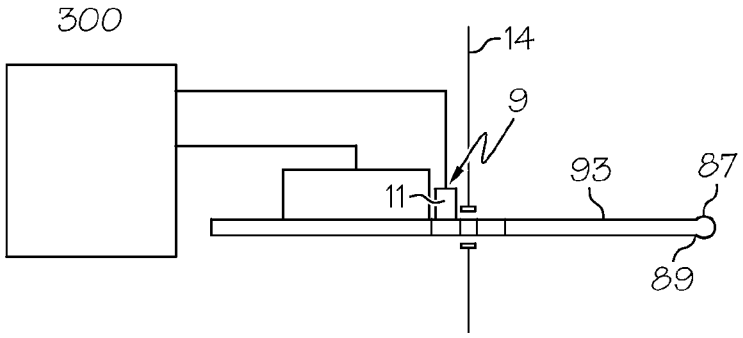
FIG. 3 is a diagrammatical illustration of a infrared temperature measuring system for measuring temperature of the tubes of the sootblower lances illustrated in FIGS. 1 and 2.
Figure 4:
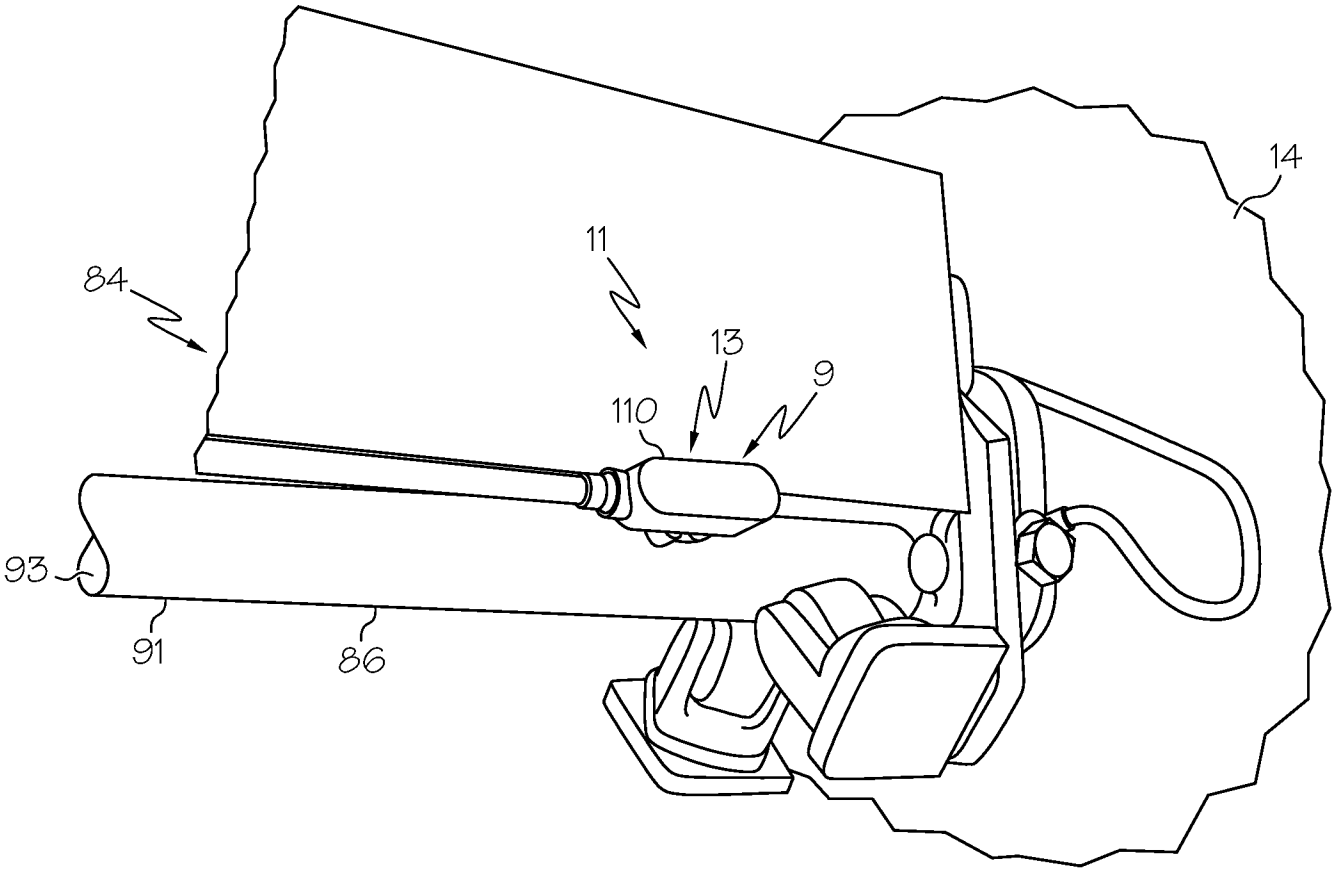
FIG. 4 is an illustration of an infrared sensor of the infrared temperature measuring system for measuring temperature of the tubes of the sootblower lances illustrated in FIG. 3.

Two types of temperature measuring systems 9 are illustrated herein. An infrared temperature measuring system 11 is illustrated in FIGS. 1 and 3. In the embodiment of the infrared temperature measuring system 11 illustrated herein an infrared sensor 110 is located outside and adjacent to the boiler 14 and, is thus, operable for measuring the wall temperature of the annular wall 93 of the lance tube 86 as it is extracted and inserted into the boiler 14. Though the infrared sensor 110 is located outside the boiler 14, it gives an accurate reading of the wall temperature because of the large thermal mass of the annular wall 93 and the rapid extraction of the lance from the furnace. These two factors result in the temperature being measured at this location to be essentially the same temperature of the lance immediately before it exits the boiler 14.

Other types of temperature measuring systems may be used. One such system is a thermocouple temperature measuring system 13 as illustrated in FIGS. 5 and 6. One or more thermocouples 114 are attached to the annular wall 93 of the lance tube 86 to measure the wall temperature of the annular wall 93 inside the boiler 14. As illustrated herein, a number of the thermocouples 114 are partially disposed from an inside surface 130 of the annular wall 93 in tight fitting holes 116 through and along a length L of the annular wall 93. Plugs 124 are disposed in the holes 116 between an outer surface 128 of the annular wall 93 and the thermocouples 114 disposed in the holes 116. The thermocouples 114 are welded, indicated by weld 126 to an inside surface 130 of the annular wall 93. The thermocouples 114 are connected to a transmitter (not shown) mounted on an outside of the lance 91 on an outside portion of the lance 91 that does not enter the boiler 14. The transmitter transmits temperature readings of the thermocouples to the control system 300 which operates the sootblower 84.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

The invention claimed is:

1. A cleaning system for cleaning heat exchanger surfaces of one or more heat exchangers in a boiler, the cleaning system comprising:

one or more sootblowers, each of the sootblowers having a lance with an elongated hollow tube and at least one nozzle at a distal end of the tube, a temperature measuring system for measuring and monitoring a temperature of the one or more sootblowers during operation of the one or more sootblowers, wherein the temperature measuring system measures and monitors a wall temperature of an annular wall of the tube to generate wall temperature measurements, and a control system for controlling steam flow through the tube and the at least one nozzle during operation of the one or more sootblowers based on the temperature measurements, wherein the control system is operable for controlling steam flow during cooling portions of insertion and extraction strokes to prevent the wall temperature measurements from exceeding a predetermined temperature limit.

2. A cleaning system as claimed in claim 1 wherein:

each of the sootblowers is operable for moving the lance in and out of the boiler in the insertion and extraction strokes, the control system controls the flow of steam through the tube and nozzle during cleaning portions and the cooling portions of the strokes, and the control system is operable for controlling the flow of steam during the cooling portions of the strokes based on the wall temperature measurements from the temperature measuring system.

3. A cleaning system as claimed in claim 1 wherein the predetermined temperature limit is a softening point or slightly less than the softening point of the tube.

4. A cleaning system as claimed in claim 2 wherein the temperature measuring system is an infrared temperature measuring system for measuring the wall temperature of the annular wall outside the boiler.

5. A cleaning system as claimed in claim 4 wherein the infrared temperature measuring system is operable for measuring the wall temperature of the annular wall outside and adjacent to the boiler.

6. A cleaning system as claimed in claim 5 wherein the predetermined temperature limit is a softening point or slightly less than the softening point of the tube.

7. A cleaning system as claimed in claim 2 wherein the temperature measuring system is a thermocouple temperature measuring system for measuring the wall temperature of the annular wall inside the boiler.

8. A cleaning system as claimed in claim 7 wherein the predetermined temperature limit is a softening point or slightly less than the softening point of the tube.

9. A cleaning system as claimed in claim 8 wherein the thermocouple temperature measuring system comprises thermocouples attached to the annular wall.

10. A cleaning system as claimed in claim 9 wherein the thermocouples are attached to an inside surface of the annular wall and are partially disposed from the inside surface of the annular wall in holes through and along a length of the annular wall.

11. A method of operating a cleaning system comprising:

using one or more sootblowers to clean heat transfer surfaces of one or more heat exchangers in a boiler, flowing cleaning fluid through an elongated hollow tube of a lance of each of the sootblowers, discharging the cleaning fluid from at least one nozzle at a distal end of the tube against the heat transfer surfaces, measuring and monitoring a temperature of the one or more sootblowers during operation of the one or more sootblowers using a temperature measuring system that measures and monitors a wall temperature of an annular wall of the tube of each of the sootblowers to generate wall temperature measurements, and controlling cleaning fluid flow through the one or more sootblowers during operation of the one or more sootblowers based on the temperature measurements of the one or more sootblowers, wherein the cleaning fluid flow through the tube and nozzle during cooling portions of insertion and extraction strokes is controlled to maintain the wall temperature measurements below a predetermined temperature limit.

12. A method as claimed in claim 11 further comprising:

moving the lance in and out of the boiler in the insertion and extraction strokes, wherein the flow of the cleaning fluid through the tube and nozzle is controlled during cleaning portions and the cooling portions of the strokes, and the flow of the cleaning fluid through the tube and nozzle during the cooling portions of the strokes is controlled based on the wall temperature measurements.

13. A method as claimed in claim 11 wherein the predetermined temperature limit is a softening point or slightly less than the softening point of the tube.

14. A method as claimed in claim 12 further comprising using an infrared temperature measuring system for the measuring and the monitoring of the wall temperature of the annular wall outside the boiler and wherein the cooling portions of the strokes occur only during the extraction strokes.

15. A method as claimed in claim 14 wherein the infrared temperature measuring system for measuring the wall temperature of the annular wall is used outside and adjacent to the boiler.

16. A method as claimed in claim 15 wherein the predetermined temperature limit is a softening point or slightly less than the softening point of the tube.

17. A method as claimed in claim 12 further comprising using a thermocouple temperature measuring system for the measuring and the monitoring of the wall temperature of the annular wall.

18. A method as claimed in claim 17 wherein the predetermined temperature limit is a softening point or slightly less than the softening point of the tube.

19. A method as claimed in claim 18 wherein the measuring of the wall temperature of the annular wall includes using thermocouples attached to the annular wall.

20. A method as claimed in claim 18 wherein the measuring of the wall temperature of the annular wall includes using thermocouples that are attached to an inside surface of the annular wall and are partially disposed from the inside surface of the annular wall in holes through and along a length of the annular wall.

21. A method as claimed in claim 11 wherein the cleaning fluid flows through the tube and nozzle during the cooling portions of the strokes at a flowrate equal to a default value unless the wall temperature of the annular wall exceeds or is about to exceed the predetermined temperature limit based on the wall temperature measurements.

22. A method as claimed in claim 21 wherein the default value is substantially zero.

23. A method as claimed in claim 22 wherein the predetermined temperature limit is a softening point or slightly less than the softening point of the tube.

24. A cleaning system as claimed in claim 2, wherein the control system controls steam flow through the tube and nozzle by varying the flowrate of the steam through the tube and nozzle during operation of the one or more sootblowers based on the wall temperature measurements.

25. A method as claimed in claim 12, wherein controlling cleaning fluid flow through the one or more sootblowers comprises varying the flowrate of the cleaning fluid through the one or more sootblowers during operation of the one or more sootblowers based on the wall temperature measurements of the one or more sootblowers.

26. A method as claimed in claim 12, wherein the cleaning fluid comprises one of steam and water and steam.

* * * * *